United States Patent [19]

Hune

[11] 4,413,683

[45] Nov. 8, 1983

[54] FIREPROOF ENCLOSURE FOR VALVE ACTUATOR

[75] Inventor: R. G. Hune, Sugarland, Tex.

[73] Assignee: Thermal Designs, Inc., Houston, Tex.

[21] Appl. No.: 198,452

[22] Filed: Oct. 20, 1980

[51] Int. Cl.[3] ..... A62C 7/00

[52] U.S. Cl. ..... 169/48; 220/88 R; 285/47; 137/382

[58] Field of Search ..... 169/48; 220/88 R, 75, 220/23.4, 4 F, 18, 902; 285/45, 47, 55; 174/52 R, 52 S; 137/377, 382, 375; 106/18.11

[56] References Cited

U.S. PATENT DOCUMENTS

| | | | |
|---|---|---|---|
| 1,155,761 | 10/1915 | Scherer | 285/47 |
| 2,754,664 | 7/1956 | Oltz | 62/114 |
| 2,808,825 | 10/1957 | Solomon | 285/47 |
| 3,092,247 | 6/1963 | Woodruff | 206/46 |
| 3,562,405 | 2/1971 | Ashford et al. | 174/52 |
| 3,589,971 | 6/1971 | Reed | 161/48 |
| 3,877,525 | 4/1975 | Husson et al. | 169/48 |
| 4,046,406 | 9/1977 | Press et al. | 285/47 |
| 4,058,328 | 11/1977 | Nickerson et al. | 285/45 |
| 4,087,624 | 5/1978 | Hitchcock | 174/57 |
| 4,104,426 | 8/1978 | Gonzalez et al. | 428/36 |
| 4,122,644 | 10/1978 | Woodruff | 52/787 |
| 4,307,813 | 12/1981 | Palmer | 220/4 R |

OTHER PUBLICATIONS

"Fire Resistant Enclosures"; Thermal Designs Inc., 5352 Prudence St., Houston, Texas 77045; J.I. 1E7A1-.AF (6034); Sep. 12, 1980.

Product brochure of Resistoflex Corporation entitled "Corrosion Resistant Firesafe TFE Clamp Valve for Flammable Fluids", 1975.

Product brochure of TOM Palmer, Inc. entitled "Fire Protection System", dated 9/1977.

*Primary Examiner*—Joseph J. Rolla
*Assistant Examiner*—Kenneth Noland
*Attorney, Agent, or Firm*—Arnold, White & Durkee

[57] ABSTRACT

Valve actuators are protected by fireproof enclosures capable of withstanding temperatures up to 2300° F. The fireproof enclosures are made up of two or more units, one of which is a center unit rigidly mounted upon the valve actuator itself. The other units are attached to the center unit by means of stepped flanges forming airtight seals therewith. Each unit has a substantially box-shaped frame with expanded metal sides, which frame, exclusive of stepped flanges, is substantially completely encased in a homogeneous body of refractory material, preferably formed by vacuum molding form a slurry of refractory material into a mold surrounding the exterior of the frame and curing the refractory material deposited thereby. The preferred refractory material is a mixture of alumina ceramic fibers and a colloidal silica binder.

16 Claims, 7 Drawing Figures

FIREPROOF ENCLOSURE FOR VALVE ACTUATOR

BACKGROUND OF THE INVENTION

1. Field of the Invention

This invention relates generally to a novel enclosure for a valve actuator, and more particularly, to an enclosure for protecting valve actuators from fire damage.

2. Description of the Prior Art

In petroleum refineries and petrochemical plants, there exist enormous amounts of flammable products being stored, pumped, and processed. These flammable products represent a very great fire hazard to all equipment where such flammable products might be present. The release of flammable products in a refinery or chemical plant can result in enormous fire damage to the plant if such flammable material is ignited. The release of flammable material can be result of the failure of a mechanical seal on a pump, the rupture of piping, the failure or leaking of a process valve, or a large number of other possible causes.

One of the primary methods in preventing large fires and in stopping them once they have started is to control the release of flammable product into the area where the fire is burning. The prevention or control of such a fire depends greatly upon cessation of the flow of flammable product before serious and irreversible damage can be done. Once the flammable product is no longer available, the fire can be easily extinguished.

In order to stop the flow of flammable products under such circumstances, many refineries and chemical plants provide isolation or block valves to shut off the flow of flammable product so that the fire can be easily extinguished. These isolation or block valves are often remote-controlled motor-operated valves. In terms of sensitivity to fire, it is usually the case that the valve actuators are more troublesome than are the valves themselves. Typically, the valves themselves used in this environment have heavy steel castings and machined parts so that they are not affected by a fire to the extent that they require protection themselves.

However, actuators of the eletromechanical type usually include soft metal, plastic parts, and sensitive electrical components that require protection from fire so that the actuator can be relied upon to activate the valve when needed, even when the valve itself is directly in the fire. Typical of the type of electromechanical valve actuator used in this environment are those sold under the designations EB-10, EB-20 and EB-30 by E. I. M. Company, Inc. of Missouri City, Tex.

A number of early attempts were made to fireproof these electromechanical valve actuators used in conjunction with isolation or block valves as part of a fire control system. One simple technique was simply to wrap the valve actuator in refractory material, for example in the form of a refractory blanket. In some cases such insulation was held in place on the actuator by a cloth bag laced together with steel cables. This method of protecting value actuators suffers from an enormous number of disadvantages. The bag itself has no structural strength and cannot withstand any significant blow or direct exposure to a fire hose stream. In addition, there is little weather resistance provided by such a cloth bag enclosure system, and there is no viable means of access to the equipment for maintenance purposes, it being difficult and tedious to unlace and replace the bag covering if the actuator requires maintenance.

There have been attempts in the prior art by both the inventor of the present invention and others to provide fire protection enclosures for electromechanical valve actuators that are built from rigid metal frames to provide adequate structural strength and are constructed of a plurality of units to provide access to various parts of the actuator for ease of maintenance and installation. However, these fire protection enclosures have suffered from a number of disadvantages. For some of the more severe applications, the structure of the refractory material used in these enclosures has been limited as to strength and weather resistance.

Additionally, these prior art fire protection enclosures have been difficult to manufacture because of the necessity of providing some means of attachment of refractory board, refractory blanket, or vacuum molded shells to the rigid frame or expanded metal sides of such framework. The prior art attempts to use vacuum molded shells that were slipped over metal frames after curing have not proved successful. Because of the size of the molded shells requuired for the actuator enclosures and the soft pliable nature of the uncured molded part, removing the molded part from the mold and handling it for transfer to a drying oven created dimensional distortions that were unacceptable in the dimensionally accurate framework of the enclosures.

It is known in the prior art to use a vacuum molding technique to produce fire protection coverings for fluid piping components such as valves, fittings, and pipe joints. An example of the application of such a vacuum molding technique is disclosed in U.S. Pat. No. 4,046,406 to Press et al. However, the fire shield disclosed in the Press patent is for fluid piping components only and provides protection only up to average flame temperatures of 1000° to 1200° F. Though Press discloses the use of an expanded metal skeletal structure disposed within a body of refractory material, no rigid metal frame is shown as part of the fire shield, and dimensional accuracy between each segment of the shield and between the shields and the fluid piping component is not critical. Further, there is no indication of an airtight seal between the two segments of Press' fire shield, capable of precluding a flame path into the area protected by the fire shield.

The problems and disadvantages enumerated in the foregoing are not intended to be exhaustive but rather are among many which tend to impair the effectiveness of previously known fire protection enclosures for valve actuators. Other noteworthy problems may also exist; however, those presented above should be sufficient to demonstrate that fire protection enclosures for valve actuators appearing in the art have proven unsatisfactory in a number of respects.

SUMMARY OF THE INVENTION

By means of the present invention there is provided an improved fire protection enclosure for valve actuators that is substantially free of the disadvantages of the prior art. The fireproof valve actuator enclosure of the present invention comprises two or more units, one of which is a center unit adapted for mounting upon the valve actuator. Each of the other units is an extension unit that is mounted upon the center unit by means of a stepped flange capable of precluding a flame path into the fireproof enclosure. Each unit has a substantially box-shaped frame with expanded metal sides. There exists no expanded metal side where an extension unit is mounted upon the center unit. The entire frame of each unit, exclusive of each stepped flange, is substantially completely encased in a homogeneous body of refractory material.

The stepped flanges used to join the units of the fireproof enclosure of the present invention form a hermetic seal that provides protection at very high temperatures up to 2300° F., while at the same time providing easy access to portions of the valve actuator for repair and maintenance purposes. The substantially complete encasement of the frame of each unit, exclusive of each stepped flange, in a homegeneous body of refractory material can be accomplished by either an aggregate method in which a dense slurry of refractory material is poured into a mold outlining the interior and exterior of the frame and allowed to cure in situ or by vacuum molding from a slurry of refractory material into a mold surrounding the exterior of the frame of each unit and curing the refractory material deposited thereby after removal from the mold. The preferred method of substantially completely encasing each frame in a homogeneous body of refractory material is the vacuum molding method. However, in either the aggregate method or the vacuum molding method, the fireproof enclosure has refractory material that exists as a homogeneous body in which there are no discontinuities from the inside to the outside of the enclosure, except for the presence of portions of the frame itself.

In those applications of the present invention involving electromechanical valve actuators, the fireproof enclosure will include a center unit functioning as a main housing cover that is mounted upon the center portion of the electromechanical valve actuator, and a switching components cover and an electric motor cover, both adapted for mounting upon the main housing cover to form tight seals therewith by means of stepped flanges capable of precluding a flame path into the fireproof enclosure.

Another feature of the present invention is the refractory material used to substantially completely encase each unit of the fireproof enclosure. The preferred refractory material is a mixture of alumina ceramic fibers and a colloidal silica binder. When the mixture of alumina ceramic fibers and colloidal silica binder has been cured, the resulting body of refractory material is itself strong and resistant to crushing. However, some occasional blows or impacts from workers' tools, physical stresses, high winds, and severe weather, may justify even further protection. This further protection is provided by means of a flexible (when cured) liquid-impermeable coating such as polyurethane.

Because of the critical nature of the stepped flanges used to form the hermetic seal between each unit of the fireproof enclosure of the present invention, the preferred material for such stepped flanges is stainless steel. In addition, stainless steel is the preferred material for all parts of each frame, save for the expanded metal.

The fireproof enclosure of the present invention, wherein the homogeneous body of refractory material is formed by vacuum molding from a slurry of refractory material into a mold surrounding the exterior of the frame of each unit and curing the refractory material deposited thereby, is capable of withstanding flame temperatures up to 2300° F. and of maintaining the temperature of an enclosed valve actuator at 200° F. or less when the enclosure is exposed to a flame temperature of 2000° F. for fifteen minutes.

In addition to this extent of protection, the vacuum molded enclosure provides an unexpectedly large extra margin of safety relative to a comparable enclosure wherein the refractory material on the enclosure consists of alumina ceramic board and alumina ceramic blanket mechanically attached to the exterior and interior of the frame respectively. A fireproof enclosure of the present invention that has its body refractory material formed by vacuum molding is capable in some cases of providing nearly double the amount of time for activating the isolation or block valve attached to the actuator.

These and other features and advantages of the present invention will become apparent with reference to the following detailed description of a preferred embodiment thereof in connection with the accompanying drawings wherein like reference numerals have been applied to like elements.

DETAILED DESCRIPTION OF THE PREFERRED EMBODIMENT

The fireproof enclosure of the present invention is useful with respect to any valve actuator used with a isolation or block valve as part of an overall system of fire prevention and control where large quantities of flammable products are involved. Thus, the fireproof enclosure of the present invention can be used to protect the sensitive parts or components of pneumatic, hydraulic, or electromechanical valve actuators. The most commonly used actuator in this environment is the electromechanical type. Regardless of the type of actuator being protected, the fireproof enclosure must include two or more units, one of which is adapted for mounting upon the valve actuator, with the remaining units being extension units adapted for mounting upon the center unit to form a tight seal therewith.

Because electromechanical valve actuators are the most common in this environment, the preferred embodiment of the fireproof enclosure of the present invention is a fireproof enclosure for protecting such an actuator. In the case of an electromechanical valve actuator the center unit for mounting upon the center portion of the electromechanical valve actuator is substantially box-shaped main housing cover. In this preferred embodiment, the extension units of the fireproof enclosure include a switching components cover and an electric motor cover, both substantially box-shaped and adapted for mounting upon the main housing cover to form tight seals therewith.

Figure 1:
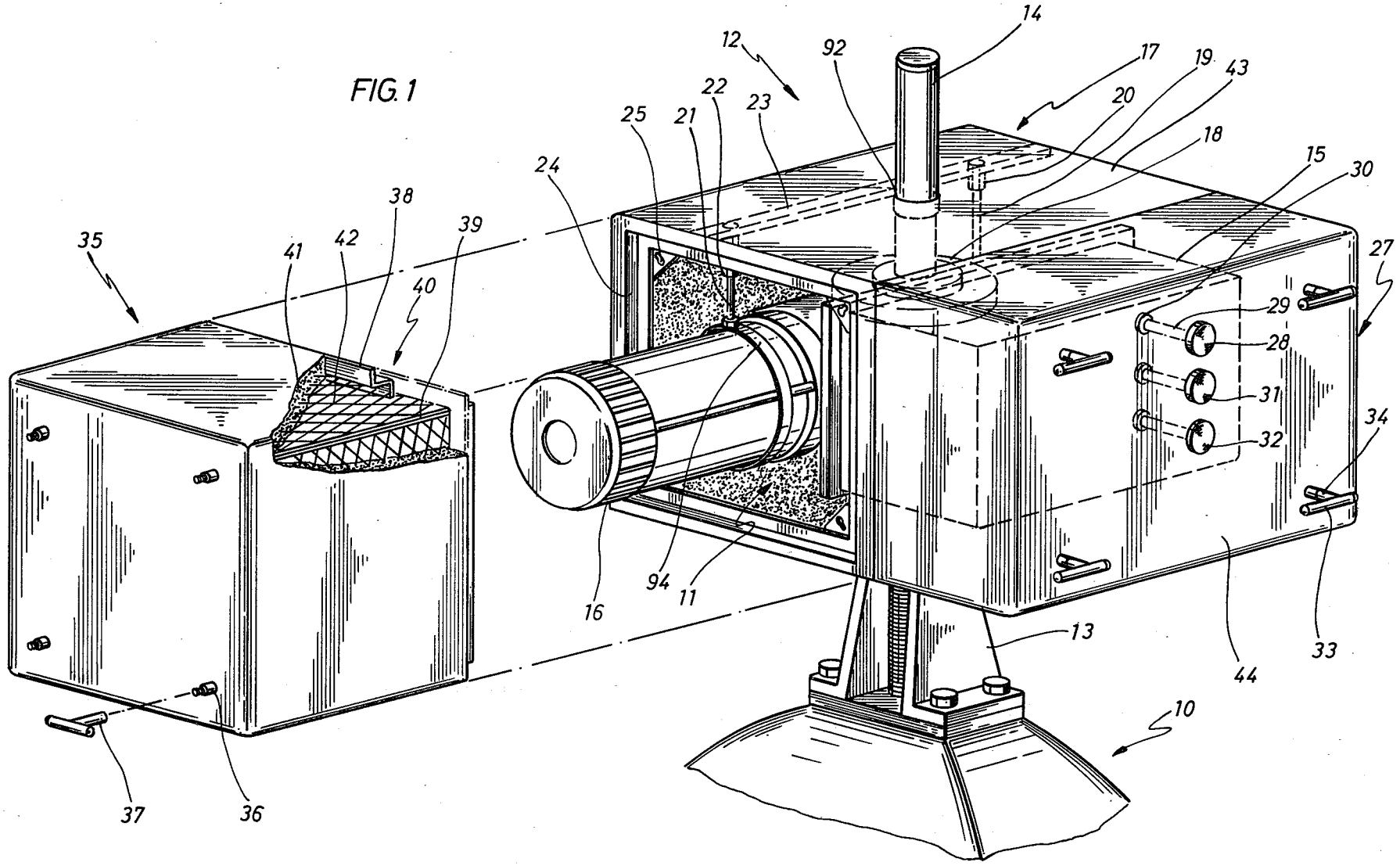
FIG. 1 is a perspective view, partially exploded and partially cutaway, of the preferred embodiment of the fireproof enclosure of the present invention, as it would appear when installed to protect a valve actuator.

In FIG. 1 there is illustrated the preferred embodiment of the fireproof enclosure as it would appear when installed to protect an electromechanical valve actuator, except that the drawing is partially exploded to reveal the manner of mating of two of the units and the components of the actuator itself and a portion of the refractory material is cutaway to reveal the frame of one of the units.

As shown in FIG. 1, valve 10 is associated with valve actuator 11, and valve actuator 11 is in turn protected by fireproof enclosure 12. The type of valve typically involved in such a system as an isolation or block valve would be a gate valve of the type well known in the art. Fireproof enclosure 12 is comprised of three separate units, main housing cover 17, switching components cover 27, and electric motor cover 35. Valve actuator 11 comprises an electrical switching compartment 15 and an electric motor 16 that are covered respectively by the switching components cover 27 and the electric motor cover 35. The center portion of valve actuator 11 includes a gear box 18 through which passes the valve stem 14 (shown with valve stem protector).

The details shown in FIG. 1 for electric motor cover 35 reveal some of the significant features of fireproof enclosure 12 found in each of its separate units. Electric motor cover 35 is mated with main housing cover 17 by means of stepped flange 38 which is shown cutawy in FIG. 1 to emphasize the dramatic stepped nature of the flange. Thus, a very tight seal is formed between stepped flange 38 and step flange 24. This seal is a hermetic seal that is capable of precluding a flame path into fireproof enclosure 12. The switching components cover 27 is mounted upon the main housing cover 17 in a similar fashion using stepped flanges to form a hermetic seal to preclude flame path into fireproof enclosure 12.

One of the more valuable features of the fireproof enclosure 12 of the present invention is that main housing cover 17, electric motor cover 35, and switching components cover 27 all provide proper access to necessary equipment for purposes of both operation and maintenance of the valve actuator 11. In terms of valve actuator maintenance, electric motor cover 35 is easily and quickly removable to provide for maintenance or repair of electric motor 16. Likewise, switching components cover 27 can be easily and quickly removed to allow for maintenance of the electrical components.

Figure 2:
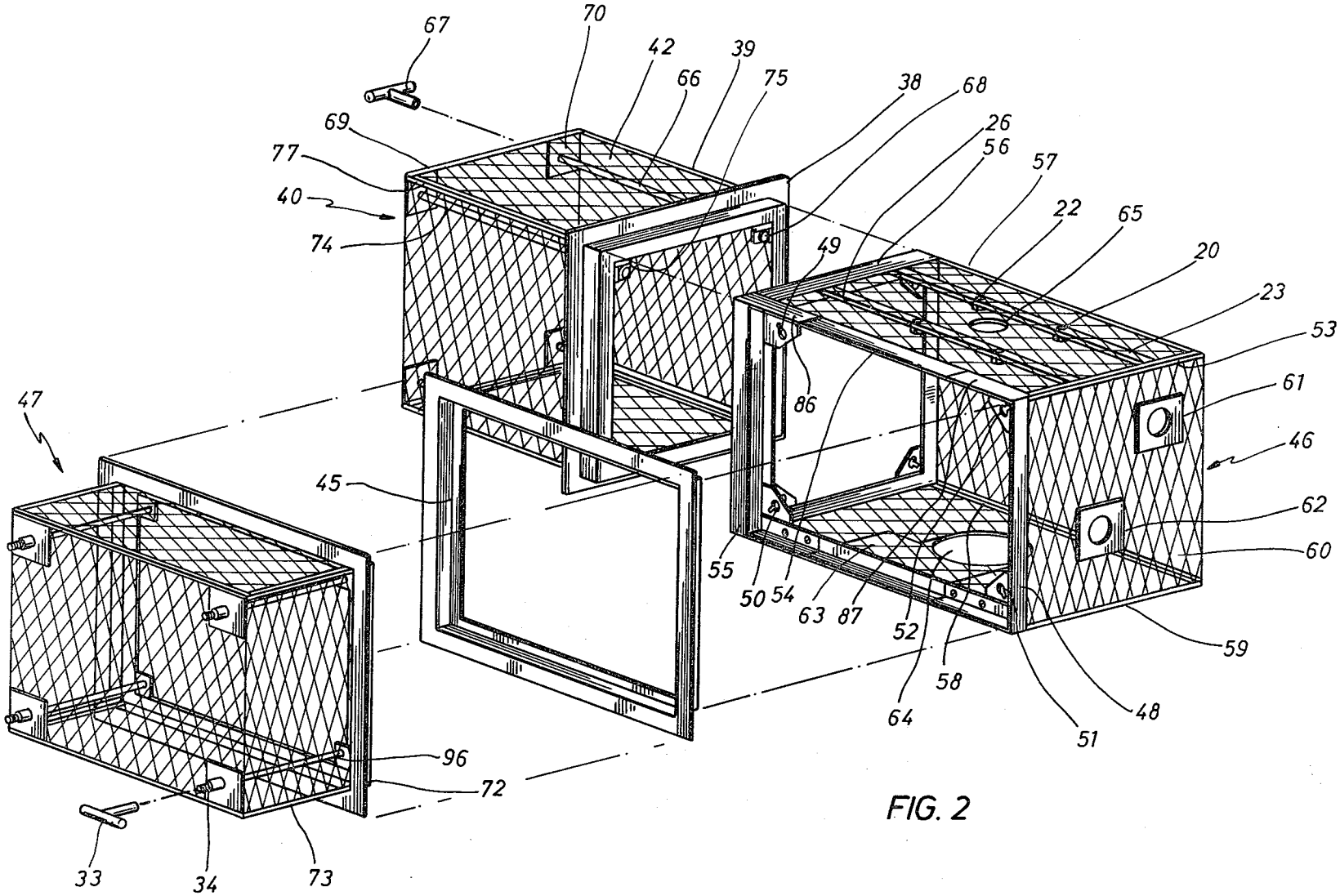
FIG. 2 is an exploded perspective view of the frame used to make the preferred embodiment of the enclosure of the present invention.

The details of how the electric motor cover 35 and switching components cover 27 are easily removed and reinstalled can be seen in FIG. 2 which gives a detailed and exploded view of the frames of each unit (or cover) of fireproof enclosure 12 as shown in FIG. 1. FIG. 2 shows frame detail only with no valve actuator 11 and no refractory material being shown. In addition, the orientation of the three units (or covers) is 90° clockwise from that of FIG. 1. Each cover has a substantially box-shaped frame with expanded metal sides. The preferred materials for all metallic parts, other than the expanded metal, is 304 stainless steel. The expanded metal is usually No. 16 carbon steel.

As can be seen in FIG. 2, the switching components cover (represented by its frame 47 only) is provided with our stainless steel rods, such as support rod 96, that are fashioned for secure attachment to the appropriate stepped flange of the main housing cover (shown by its frame 46 only) at positioning slot 51 attached to the appropriate stepped flange portion of the main housing cover. Rod 96 is guided by support tube 34 and is threadably engaged with Tee handle 33, thus providing means of tightening the mated sections of the stepped flanges to produce a hermetic seal between the switching components cover 27 and the main housing cover 17. A similar arrangement of stainless steel rod, support tube, and Tee handle is provided for each of the four corners of the switching components cover.

Figure 3:
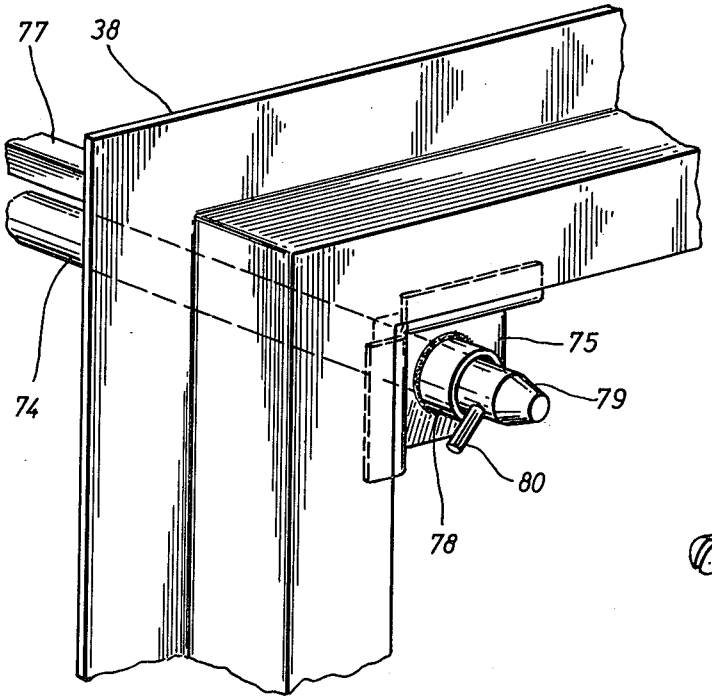
FIG. 3 is a detailed view of a corner of the stepped flange of an extension unit of the preferred embodiment of the enclosure.

In a similar fashion the electric motor cover (shown in FIG. 2 only by its frame 40) is installed and mounted upon the main housing cover. The details of stainless steel support rod 74 and support plate 75 are shown in FIG. 3. Support plate 75 is attached to stepped flange 38 at the upper lefthand corner. Support rod 74 passes through support ring 78 mounted on support plate 75. Support rod 74 has a frustoconical end 79 that is preceded immediately by a restricting pin 80.

Figure 5:
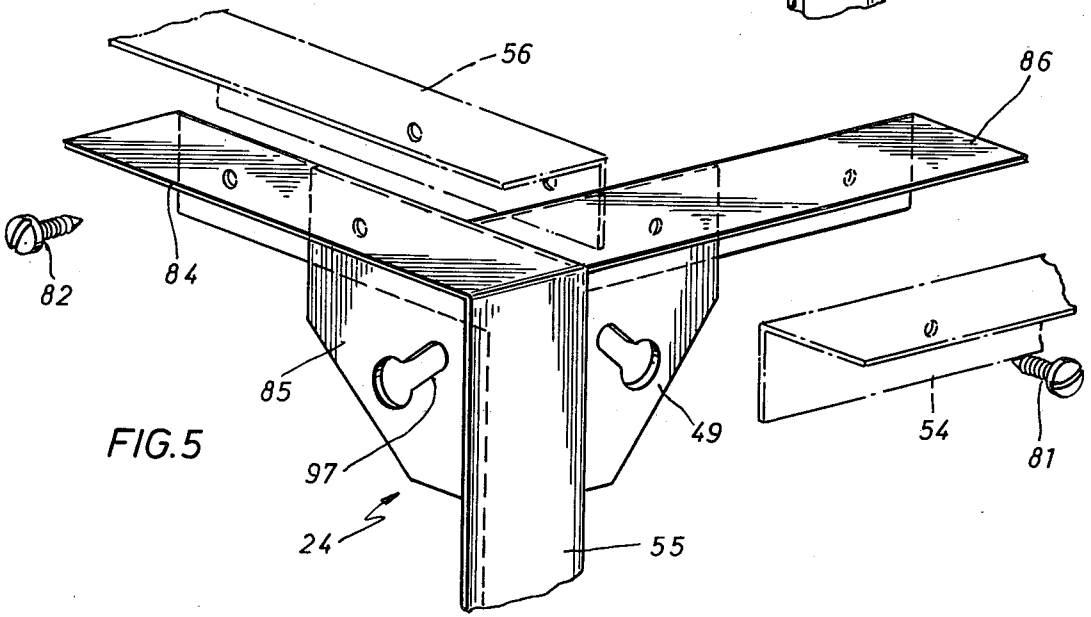
FIG. 5 is an exploded detailed view of a corner of another stepped flange of the center unit of the preferred embodiment of the enclosure.

FIG. 5 depicts the detail of the upper portion of corner post 55, that is the common member of the two stepped flanges of the main housing cover 17, one for mating with electric motor cover 35 and one for mating with the switching components cover 27. When the electric motor cover 35 is mounted upon the main housing cover 17, restricting pin 80 in FIG. 3 is passed through positioning slot 97 on positioning plate 85 (in FIG. 5), and then turned to be locked in place and tightened.

Figure 6:
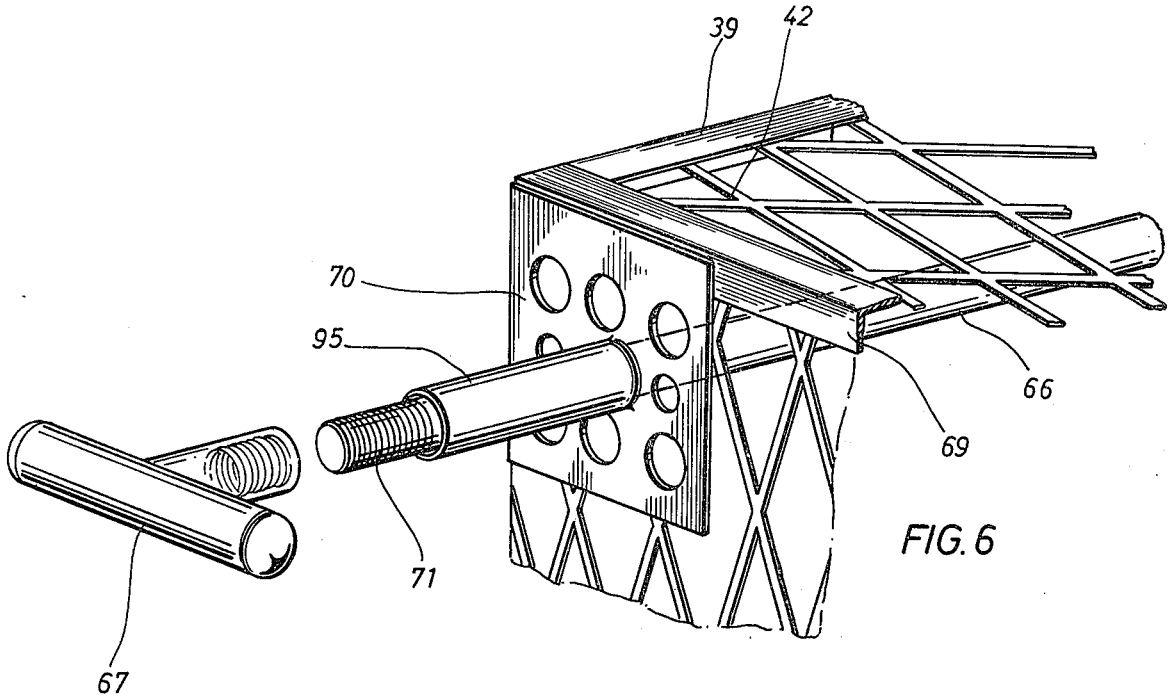
FIG. 6 is a detailed view of one of the Tee handles of one of the extension units depicted in FIG. 2.

In FIG. 6 there is depicted the detail of stainless steel support rod 66 and Tee handle 67. The arrangement depicted in FIG. 6 is the same as that for each of the four support rods of both electric motor cover 35 and switching components cover 27. The other end of support rod 66 from that shown in FIG. 6 would be attached to the main housing cover stepped flange 24 at positioning slot 25 (See FIG. 1). As shown in FIG. 6, support rod 66 comes through a support plate 70 attached to rigid member 69 near the point where rigid member 69 is joined with rigid member 39. Support plate 70 has mounted thereon support tube 95 through which support rod 36 passes. Tee handle 67 is threadably engaged with threads 71 at the outermost end of support rod 66. Tee handle 67 is used to loosen and remove support rod 66 so that electric motor cover 35 can be removed for repairing or maintaining the electric motor or conduit.

As shown in FIG. 1, the fireproof enclosure 12 also has the valuable feature of ease of operation without the necessity of disturbing its fireproof integrity. The electrical switching compartment 15, which is typical of electromechanical valve actuators of the type that this preferred embodiment is designed to protect, have push button operation wherein the actuator is controlled by three push buttons, such as push button 30, one for opening the valve, one for closing, and one for stopping movement in either direction. These push buttons can still be operated when fireproof enclosure 12 is completely installed. This is accomplished by, for example, extension rod 29 attached to push button 30 at electrical switching compartment 15, which is then attached to external push button 28. A similar arrangement is made to provide for external push buttons 31 and 32, so that all push buttons associated with electrical switching compartment 15 can be operated without the necessity of removing switching components cover 27.

Although not shown in FIG. 1, main housing cover 17 is also adapted to facilitate operation of manual controls of valve actuator 11 without the necessity of removing any unit or cover of fireproof enclosure 12. Electromechanical valve actuators such as valve actuator 11 are often provided with a hand wheel for accomplishing manual opening and closing of the valve and an accompanying clutch for switching from the manual mode of operation to the motor driven mode of operation. As can be seen in the detail of FIG. 2, the main housing frame 46 is provided with support extension plates 61 and 62, through which extensions are provided for external mounting of the hand wheel and a declutching handle for switching from the manual to the motor driven mode of operation.

The physical configuration of fireproof enclosures of the present invention will vary depending upon the particular model of valve actuator involved. However, certain features basic to the method of manufacturing such fireproof enclosures are revealed from the details of FIG. 2. The first step in any process of manufacturing is to construct the frames 40, 46 and 47 for the electric motor cover, main housing cover, and switching components cover, respectively. All of these frames must be constructed in accord with the dimensions of the valve actuator 11 to provide proper clearance with the components of the valve actuator. As can be seen for electric motor cover frame 40 in FIG. 2, each basic unit or cover is a substantially box-shaped frame with expanded metal sides, there being no expanded metal side where the electric motor cover is attached to the main housing cover. The left, right, and back sides of electric motor cover frame 40 comprises a continuous sheet of expanded metal that turns at 90° to form the two back vertical edges of the frame. In the manufacture of a frame such as electric motor cover frame 40, a continuous panel of expanded metal can be bent at right angles using conventional equipment. However, where separate panels of expanded metal must be joined with other panels of expanded metal, it is necessary to form the edges of the frame with rigid metal members such as members 39, 69 and 77. Each panel of expanded metal is then welded to the rigid metal members 39, 69 and 77. A similar arrangement of rigid metal members to join panels of expanded metal is provided for the bottom side of electric motor cover frame 40. Further, the four sides of stepped flange 38 also constitute rigid metal members forming edges of the substantially box-shaped frame 40 for the electric motor cover. Therefore, the electric motor cover frame 40, as shown in FIG. 2, has ten rigid metal members forming its edges, four of which are the four sides of stepped flange 38.

The switching components cover frame 47 is constructed in a similar fashion to electric motor cover frame 40. Therefore, switching components cover frame 47 is substantially box-shaped with expanded metal sides, there being no expanded metal side where switching components cover 27 is attached to main housing cover 17. And as shown in FIG. 2, switching components cover frame 47 has ten rigid metal members forming the edges of its box shape, four of which are the four sides of stepped flange 72.

Additional features of the main housing cover frame 46 as seen in FIG. 2 are directed to providing ease of installation of main housing cover 17 onto valve actuator 11. In particular, the frame is provided with cutout 65 for the valve stem protector 14 and cutout portion 64 for the valve yoke 13. In addition, the overall design of main housing cover frame 46 is a splice frame design which allows for ease of installation and disassembly. Specifically, corner post 55, which forms a side of both the stepped flange for mating with the electric motor cover 35 and stepped flange for mating with switching components cover 27, can be removed completely from the main housing cover frame 46. In addition, panel 63 represents a cutout of the expanded metal bottom side of the main housing cover frame 46. When this panel 63 is removed (and the refractory material attached thereto for the finished product fireproof enclosure), there is provided ease of installation about the valve yoke 13 particularly when centerpost 55 is not present.

Figure 4:
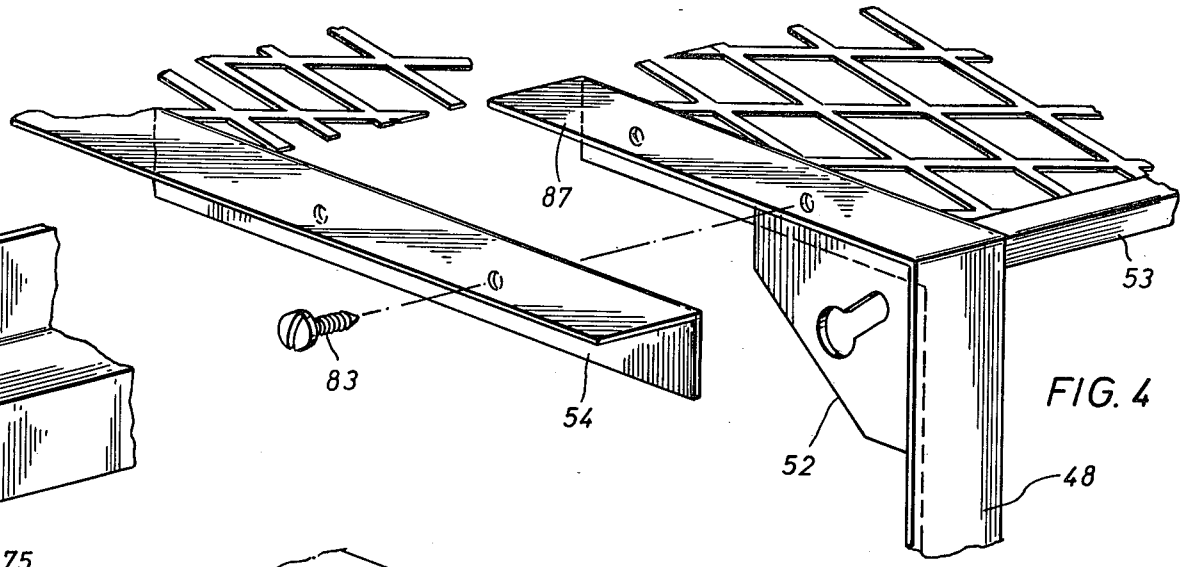
FIG. 4 is an exploded detailed view of a corner of a stepped flange of the center unit of the preferred embodiment of the enclosure.

The details of how the spliced frame design of main housing cover frame 46 is constructed can be seen in FIGS. 4 and 5. FIG. 4 depicts the detail of the top righthand corner of the stepped flange of main housing cover frame 46 as the stepped flange 72 would mate therewith. And FIG. 5 depicts the top portion of corner post 55 common to both stepped flanges on main housing cover frame 46. The bottom corners of this stepped flange would reveal similar detail to that shown in FIGS. 4 and 5. Rigid member 54 is attached by means of sheet metal screws to member 86, which in turn is welded to corner post 55 where positioning plate 49 is located, and is also attached at its other end to member 87 which is welded to corner post 48 where positioning plate 52 is located. Thus, member 54 joins the removable corner post 55 to the remainder of the frame of the main housing cover frame 46. Stepped flange 24 to which the stepped flange 38 of the electric motor cover 35 is mated also shares corner post 55. A corner of stepped flange 24 is formed by member 84 welded to corner post 55 where positioning plate 85 is located. Member 56 is attached to member 84 by sheet metal screw 82. Similar sheet metal screws 81 and 83 attach are used to attach member 54 at the locations described above.

One further item should be noted with respect to the spliced frame design of main housing cover frame 46. Because of the spliced frame portion of that main housing cover it is usually advisable to use a reinforcing stepped flange 45 as shown in FIG. 2. Stepped flange 45 adds additional structural integrity and is fitted between stepped flange 72 of the switching components cover 27 and the main housing cover 17. In addition, when installing the fireproof enclosure 12 all stepped flanges are provided with gaskets formed from gasket paper or cerablanket strips.

A further feature related to installation and mounting of the main housing cover 17 can be seen in the details of both FIG. 1 and FIG. 2. There exists at the top side of main housing cover frame 46 two support brackets 23 and 26. These support brackets contain extension nuts, such as extension nuts 20 and 22. To these extension nuts are attached all-thread studs that support the main housing cover on the center portion of the valve actuator 11 so as to make the overall system more resistant to external forces and the resulting stresses. All-thread studs 19 and 21 are attached to extension nuts 20 and 22 respectively and are in turn attached to various portions of the valve actuator. For example, stud 21 is attached to support band 94 that wraps around the electric motor 16. The overall support system based on the use of such support brackets, extension nuts, and all-thread studs will vary depending on a geometry of a particular valve actuator.

Once the frames, such as main housing cover frame 46, electric motor cover frame 40, and switching components cover frame 47, are formed, the frames must be completely encased in a homegeneous body of refractory material. As shown in FIG. 1, the homegeneous body of refractory material 41 represents an essentially continuous phase without interruptions or air gaps except where an extension of the electric motor cover frame 47 protrudes therethrough or where interrupted by expanded metal 42.

This homogeneous body of refractory material can be composed of any suitable refractory material and can be formed in any suitable fashion. One manner of producing the homogeneous body of refractory material around the particular frame involved is to form an aggregate mix of an appropriate refractory material and allow it to cure in a mold which holds it around the frame to produce the proper thickness of refractory material. This essentially in situ curing operation requires long periods of time and is very difficult to successfully accomplish.

Therefore, the preferred method of forming the homogeneous body of refractory material is by vacuum molding from a slurry of refractory material into a female mold surrounding the exterior of the substantially box-shaped frame of each cover and curing the refractory material deposited thereby. Though any suitable refractory material may be used in the vacuum molding process, the preferred material is alumina ceramic fibers, particularly bulk short staple alumina fibers. It is also preferred to provide a colloidal silica binder that is impervious to moisture when cured. The preferred final cured homogeneous body of refractory material is approximately 60% alumina fibers and 40% colloidal silica binder.

Figure 7:
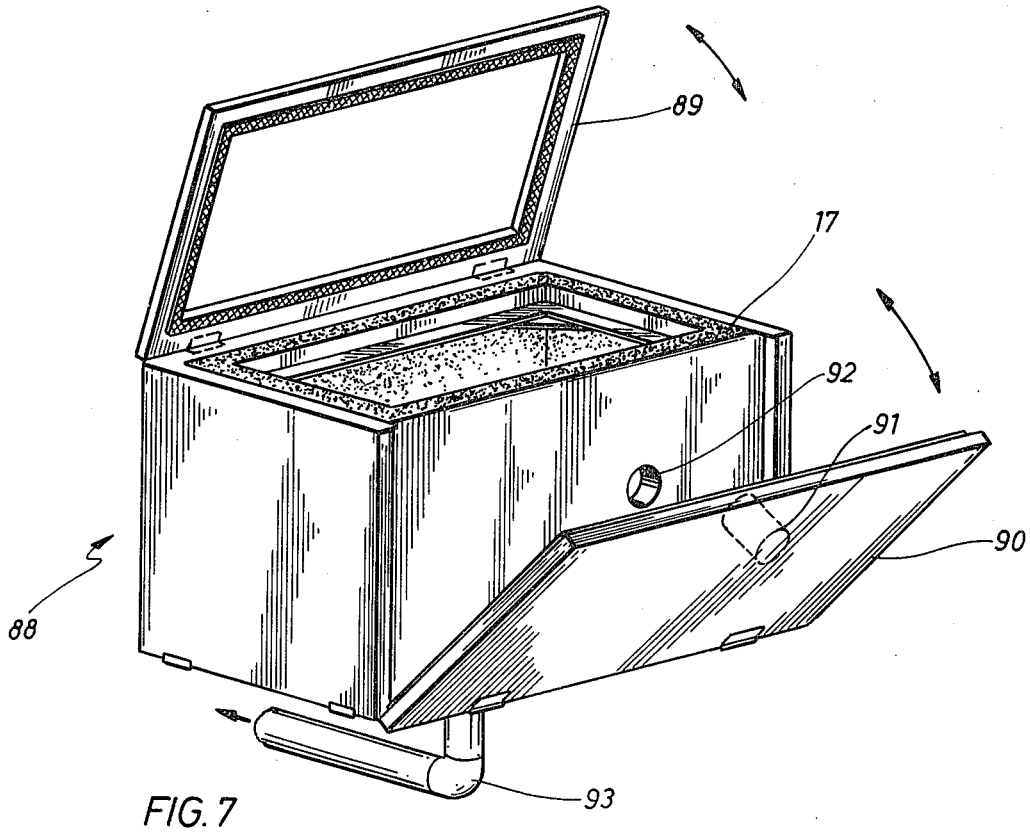
FIG. 7 is a perspective view of one of the units of the preferred embodiment of the enclosure, as the mold used to make the unit is being opened.

The general method for vacuum molding the homogeneous body of refractory material onto the particular frame involved is depicted in FIG. 7. FIG. 7 shows the main housing cover 17 being removed from the female mold 88 with hinged panels 89 and 90 being opened. Cylinder 91 is placed on hinged panel 90 to provide the opening 92 for the valve stem protector to pass through.

In the preferred method of vacuum molding, the entire mold 88, in which has been inserted the particular frame onto which the homogeneous body of refractory material is to be placed, is submerged into a felting tank containing a mixture of alumina fibers and colloidal silica binder. Preferably, this mixture has from 0.5 to 1.0 weight percent (preferably 0.75%) of the alumina fibers added to a 20% colloidal silica/80% water solution.

A high vacuum is pulled on the mold, and this vacuum draws the fibers and binder solution through the frame to the wall of the mold. Thus, the fibers immediately build up from this point next to the wall of the mold, and proceed back through the expanded metal and continue to build up to the desired thickness surrounding the frame. The thickness of the homogeneous body of refractory material and its density depend on the amount of vacuum pulled and the amount of time spent drawing that vacuum. The vacuum may be as great as 23 inches Hg for larger units. The time for drawing the vacuum varies from 0.75 to 2.0 minutes. The homogeneous layering of fibers in this fashion in and around the metal frame produces a very strong structure of substantial integrity. The typical overall wall thickness will vary from one and one-half to two inches, usually equal thickness on both sides of the expanded metal.

After completely encasing the frame with refractory material, the encased frame is pulled from the felting vat and is dewatered by continuing to pull the vacuum on the mold for about the same amount of time that was used to deposit the fibers in the mold. Following the dewatering operation the homogeneous body of refractory material is cured, usually at 350° F. for six to eight hours.

The design of the frame of each unit (or cover) of the fireproof enclosure as depicted in FIG. 2 provides a very significant feature, advantageous and necessary to the process of vacuum molding and curing described above. Previous attempts in the prior art to vacuum mold refractory material into very large units such as those involved in the present fireproof enclosure have not been successful because of the inability to provide dimensional stability and prevent unacceptable contortions. The rigid metal members of the frames of the units in FIG. 2, and particularly the stepped flanges, provide the dimensional stability heretofore unachievable with very large molded objects of refractory material.

Another problem experienced in previous attempts to vacuum mold such large articles was an inability to handle the articles after the molding process itself. The molded article must be removed from the mold and carried to a proper place for curing all without directly handling the article and causing distortions in its molded body. Support plates such as 75 and 68 on the electric motor cover frame 40, and 49 and 52 on the main housing cover frame 46, and support tubes such as 95 as shown in FIG. 6, provide a means for overcoming this handling problem. Attachments for removing the molded covers from the mold and handling them prior to curing can be fastened at such support plate or support tube locations, thus allowing conveyance and hanging of the molded covers without directly handling them.

Upon curing the homogeneous body of refractory material forms a hard crustlike surface that is resistant to many external impacts but can in some cases be cracked or split. For these and other reasons such as providing additional protection from moisture, the outside of the completely cured homogeneous body of refractory material in each unit is often coated with a flexible liquid-impermeable coating. A preferred flexible liquid-impermeable is a 20 to 30 mil thick polyurethane coating. A suitable polyurethane coating is that produced by Brydek, Inc. Coatings Company under the designation Senotex 3004.

When finally installing fireproof enclosure 12 additional precautions are advisable to ensure the fireproof integrity of the enclosure. For example, refractory felt is used to cover the valve stem protector 14 where the stem extends above the enclosure. Also, moldable refractory felt is used to protect the first foot of electrical conduit where the conduit enters fireproof enclosure 12 and to cover valve yoke 13 where yoke 13 enters the enclosure to as much as a foot below the bottom side of the main housing cover 17. Further, at all places where moldable refractory felt is used, and where cutout panels are necessary for installation, where portions of the frame, other than the stepped flanges, protrudes through the homogeneous body of refractory material, extensive use of refractory caulking is advised.

When a fireproof enclosure such as fireproof enclosure 12 of FIG. 1 is manufactured and installed as described above, the fireproof enclosure is capable of withstanding flame temperatures in excess of 2300° F. and of maintaining the temperature of enclosed valve actuator 11 at 200° F. or less when the fireproof enclosure 12 is exposed to a flame temperature of 2000° F. for 15 minutes. This standard has been established by a number of companies in the petrochemical industry to provide a delay of 15 minutes for purposes of providing the necessary time for the valve to be closed or opened as required on command from a remote location to allow shutdown of the flow of flammables in the event of a fire.

When a fireproof enclosure such as fireproof enclosure 12 of FIG. 1 is constructed and installed as described above, and when the homogeneous body of refractory material consists of one and one-half inches of vacuum molded alumina ceramic fibers with a colloidal silica binder, the fireproof enclosure is not only capable of meeting this industry standard but is also capable of providing an unexpectedly superior extra margin of safety, thus providing additional time to assure the shutdown of the flow of flammables. This superior result is evident from tests conducted with such a fireproof enclosure and with a comparable enclosure made by using the same structural frame but hand covering the frame externally with a one-inch thick alumina ceramic board and internally with a one-inch thick alumina ceramic blanket, thus providing comparable amounts of similar refractory material. In these tests conducted by Factory Mutual Research Corporation, the vacuum molded fireproof enclosure described above was subjected to a test flame with temperatures ranging from 1600 to peaks in excess of 2000° F., and the internal temperatures within the fireproof enclosure did not reach 200° F. until 26.7 minutes of flame exposure. However, the above-described hand-covered enclosure was subjected to a similar test flame, and inside temperatures in the area of the electrical conduit connecting the switch control to the motor reached 350° F. within fifteen minutes of flame exposure.

Further modifications and alternative embodiments of the fireproof enclosure of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement apart. For example, equivalent elements or materials may be substituted for those illustrated and described herein, parts may be reversed, and certain features of the invention may be utilized independently of the use of other features, all as would be apparent to one skilled in the art after having benefit of this description of the invention.

What is claimed is:

1. A fireproof enclosure for protecting a valve actuator, said fireproof enclosure comprising a plurality of units, one of said units being a center unit adapted for mounting upon a valve actuator and each other unit being an extension unit adapted for mounting upon the center unit to form a tight seal therewith, each unit having a substantially box-shaped frame with expanded metal sides, there being no expanded metal side where an extension unit is mounted upon the center unit, wherein the tight seal between the center unit and each extension unit is formed by a stepped flange capable of precluding a flame path into said fireproof enclosure and wherein the box-shaped frame of each unit, exclusive of each stepped flange, is substantially completely encased in a homogeneous body of refractory material formed by vacuum molding from a slurry of refractory material into a mold surrounding the exterior of the substantially box-shaped frame of each unit and curing the refractory material deposited thereby.

2. A fireproof enclosure of claim 1, wherein the substantially box-shaped frame of each unit has at least ten rigid metal members forming the edges of the frame, with at least four of the rigid metal members consisting of the four sides of a stepped flange.

3. A fireproof enclosure of claim 1 or 2, wherein the frame of each unit includes a plurality of attachment points not encased in the homogeneous body of refractory material, which points are capable of receiving attachments for conveying each unit after vacuum molding without the necessity of directly handling the molded but uncured unit.

4. A fireproof enclosure of claim 1 or 2, wherein the refractory material is a mixture of alumina ceramic fibers and a colloidal silica binder.

5. A fireproof enclosure of claim 1 or 2, wherein said fireproof enclosure is capable of withstanding flame temperatures up to 2300° F. and of maintaining the temperature of the enclosed valve actuator at 200° F. or less when said fireproof enclosure is exposed to a flame temperature of 2000° F. for 15 minutes.

6. A fireproof enclosure of claim 1 or 2, wherein the stepped flanges are stainless steel.

7. A fireproof enclosure of claim 6, wherein the flexible liquid-impermeable coating is a polyurethane.

8. A fireproof enclosure of claim 1 or 2, wherein the homogeneous body of refractory material is covered with a flexible liquid-impermeable coating.

9. A fireproof enclosure for protecting an electromechanical valve actuator, said fireproof enclosure comprising:

a substantially box-shaped main housing cover adapted for mounting upon the center portion of the electromechanical valve actuator, and a switching components cover and an electric motor cover, both substantially box-shaped and adapted for mounting upon the main housing cover to form tight seals therewith, each cover having a substantially box-shaped frame with expanded metal sides, there being no expanded metal sides where the electrical switching components cover and the electric motor cover are mounted upon the main housing cover, wherein the tight seal between the main housing cover and the switching components cover and the electric motor cover is formed by a stepped flange capable of precluding a flame path into said fireproof enclosure and wherein the box-shaped frame of each cover, exclusive of each stepped flange, is substantially completely encased in a homogeneous body of refractory material formed by vacuum molding from a slurry of refractory material into a mold surrounding the exterior of the substantially box-shaped frame of each cover and curing the refractory material deposited thereby.

10. A fireproof enclosure of claim 9, wherein the substantially box-shaped frames of both the switching components cover and the electric motor cover have at least ten rigid metal members forming the edges of the respective frames, four of the rigid metal members consisting of the four sides of a stepped flange.

11. A fireproof enclosure of claim 10, wherein the substantially box-shaped frame of the main housing cover has at least eleven rigid metal members forming the edges of the frame, seven of the rigid metal members consisting of the sides of two stepped flanges that have one side in common.

12. A fireproof enclosure of claim 9, 10 or 11, wherein the frame of each cover includes a plurality of attachment points not encased in the homogeneous body of refractory material, which points are capable of receiving attachments for conveying each cover after vacuum molding without the necessity of directly handling the molded but uncured cover.

13. A fireproof enclosure of claim 9, 10 or 12, wherein the refractory material is a mixture of alumina ceramic fibers and a colloidal silica binder.

14. A fireproof enclosure of claim 9, 10 or 11, wherein the stepped flanges are stainless steel.

15. A fireproof enclosure of claim 9, 10 or 11, wherein the homogeneous body of refractory material is covered with a flexible liquid-impermeable coating.

16. A fireproof enclosure of claim 15, wherein the flexible liquid-impermeable coating is a polyurethane.

* * * * *